US006183326B1

(12) United States Patent
Stein et al.

(10) Patent No.: US 6,183,326 B1
(45) Date of Patent: Feb. 6, 2001

(54) COMMUNICATION BUOY WITH ICE PENETRATING CAPABILITIES

(75) Inventors: Peter J. Stein, Hollis, NH (US); Armen Bahlavouni, Waltham; Douglas W. Andersen, Acton, both of MA (US)

(73) Assignee: Scientific Solutions, Inc., Hollis, NH (US)

( * ) Notice: Under 35 U.S.C. 154(b), the term of this patent shall be extended for 0 days.

(21) Appl. No.: 09/406,488

(22) Filed: Sep. 27, 1999

(51) Int. Cl.[7] ..... B63B 22/18

(52) U.S. Cl. ..... 441/21; 175/18; 441/28; 441/33

(58) Field of Search ..... 175/18; 441/32, 441/33, 21, 28, 29, 1, 11

(56) References Cited

U.S. PATENT DOCUMENTS 4,923,019 5/1990 Gammon .
5,246,078 * 9/1993 Kryger et al. ..... 175/18
5,308,270 * 5/1994 Travor et al. ..... 441/21
5,319,376 * 6/1994 Eninger ..... 441/3
5,593,332 * 1/1997 Green ..... 441/11

* cited by examiner

*Primary Examiner*—Sherman Basinger
(74) *Attorney, Agent, or Firm*—Davis and Bujold

(57) ABSTRACT

A deployable buoy having a nose cone and a tail section interconnected by a housing. The buoy comprises an outer shell and a canister with the outer shell axially moveable relative to the canister. An expansion chamber is provided between the outer shell and canister to produce and increase the axial length of the buoy and thereby increase the buoyancy of the buoy from a low buoyancy to a greater buoyancy and to orient and maintain the buoy in a substantially vertical orientation. The buoy is provided with a hot fluid generation source to melt a layer of ice and a nose cone ejection system to expose an antenna for the transmission of data to the central processing system.

14 Claims, 3 Drawing Sheets

COMMUNICATION BUOY WITH ICE PENETRATING CAPABILITIES

This invention was made with Government support under Grant No. 00014-98-1-0814 awarded by the Department of the Navy, Office of Naval Research. The Government has certain rights in this invention.

The present invention relates to a deployable buoy, and specifically to an improved data transmission buoy, which can be deployed by an underwater vehicle and is capable of penetrating through a layer of ice from below to reach an air surface and thereafter transmit data stored in the buoy to a desired central processing center.

BACKGROUND OF THE INVENTION

In the prior art, deployable buoys are well known. However, many of these buoys are cumbersome and not well suited either for deployment by an underwater vehicle or for gently floating toward the surface and penetrating a substantial layer of ice, e.g. one to two meters thick, in order, to transmit information to a central processing system.

SUMMARY OF THE INVENTION

It is an object of the invention is to provide a buoy with both data storage and transmission capabilities for receiving data from an underwater vehicle and transmitting the received data to a central processing center.

A further object of the invention is to provide a buoy which when submerged is initially only slightly buoyant, e.g. has a positive buoyancy of only about one to four ounces, until the buoy contacts a layer of ice so as to gently position the buoy adjacent an undersurface of the ice regardless the depth at which the buoy is deployed.

A still further object of the invention is to provide the buoy with a mechanism for vertically orienting the buoy to facilitate penetration of the buoy through a layer of ice from below the ice.

Yet another object of the invention is to provide the buoy with a mechanism for melting through a layer of ice, e.g. one to two meters thick, in an efficient and effective manner.

Still another object of the invention is to provide the buoy with a central processing unit which activates a mechanism to orient the buoy to the vertical, commences activation of the melting stage, and automatically transmits stored information, downloaded from its submerged deploying vehicle, to a central processing station once the buoy is suitably deployed.

According to the invention there is provided a data transmitting buoy for use in transmitting data from ice covered bodies of water comprising: a water tight elongate housing having a forward end and a rear end; a transmitter within the housing; an exposable antenna connected to the transmitter to transmit data; a buoyancy and orientation adjusting system for adjusting the buoyancy and orientation of the buoy, when submerged in the water, from a relatively low buoyancy to a relatively high buoyancy, in which high buoyancy condition the elongate housing is urged to a vertical orientation with the forward end uppermost; and an ice melting system to enable the buoy to burrow upwardly through the ice cover when in contact therewith in said vertical orientation.

The buoyancy and orientation system preferably axially extends the buoy from an unextended relatively low buoyancy state, in which the center of gravity of the buoy substantially coincides with the center of buoyancy of the buoy, to an extended relatively high buoyancy state in which the center of buoyancy of the buoy is closer to the forward end than is the center of gravity of the buoy thereby to urge the elongate housing to a vertical orientation.

The buoyancy and orientation system may comprise an axially expandable chamber forward of the center of gravity of the buoy; a container of pressurized gas releasable, when desired, to axially expand the chamber; and an equipment canister, within the housing, partially defining the chamber, having a weighted end at the rear end of the housing and being moveable axially relative to the housing by expansion of the chamber; whereby expansion of the chamber increases the buoyancy to the relatively high buoyancy, moves the equipment canister rearwardly of the buoy, provides the increased buoyancy forward of the center of gravity and together with the axial rearward movement of the equipment canister provides a center of buoyancy forward of the center of gravity of the buoy to urge the buoy to said vertical orientation.

Floats may be provided which are captively housed at the rear end prior to expansion of the chamber and freely releasable from the buoy upon the expansion of the chamber.

A control unit is provided within the canister to control the transmitter and a valve operable to release the gas from the container upon contact of the buoy with the underside of a surface layer of ice.

The ice melting system preferably comprises a heat generator for producing hot fluid to melt the ice in contact with the buoy to allow the buoy to burrow upwardly through the layer of ice to expose the forward end and to allow exposure of the antenna for the transmission of said data, the heat generator being activated by the control unit.

The heat generator may comprise a reactant; a pump housed in the canister and controlled by the control unit to pump, upon initial activation, a reaction initiator into the reactant to initiate an exothermic reaction and subsequently to pump water to fuel the reaction, to supply heated fluid to the forward end to melt the ice.

The forward end is preferably a conical metal nose cone heated by the heated fluid with a central opening through which the heated fluid is emitted to melt the ice.

The reactant may be Pyrosolve-Z (hereinafter PZ) (manufactured and available from Consolidated Technologies Ltd., St. Johns, Newfoundland, Canada) carried in an impervious heat/pressure resistant bag, the reaction initiator being hydrochloric acid, the water being seawater whereby the reaction produces steam under pressure which fractures the bag to release the steam to the nose cone.

Preferably the relative low buoyancy is about one to about four ounces thereby to promote only a gentle rate of upward movement of the buoy, when submerged in water, toward an ice cover and the relatively high buoyancy is about one to two pounds to provide firm contact of the nose cone of the buoy with the ice cover during the burrowing of the buoy through the ice cover.

Also according to the invention, an elongate data transmission buoy comprises an axially expandable housing; an ejectable nose cone at one end of the housing; a weighted end section at an opposed end of the housing; an axially expandable chamber within the housing; a source of pressurized gas; a control system to release the pressurized gas from the source, when desired, into the chamber to axially expand the chamber and housing thereby to increase buoyancy of the buoy and through the operation of the weighted end section to orient the buoy vertically with the nose cone uppermost; a heat producing system controlled by the control system to melt an ice layer, when contacted by the nose cone when the buoy is oriented vertically, to allow the buoy to burrow upwardly through the ice layer; and a nose cone ejector operable by the control system following said burrowing through the ice layer to eject the nose cone to expose an antenna, located in said housing, for transmission of the data under the control of the control system.

BRIEF DESCRIPTION OF THE DRAWINGS

The invention will now be described, by way of example, with reference to the accompanying drawings, in which.

DETAILED DESCRIPTION OF THE PRESENT INVENTION

Figure 1:
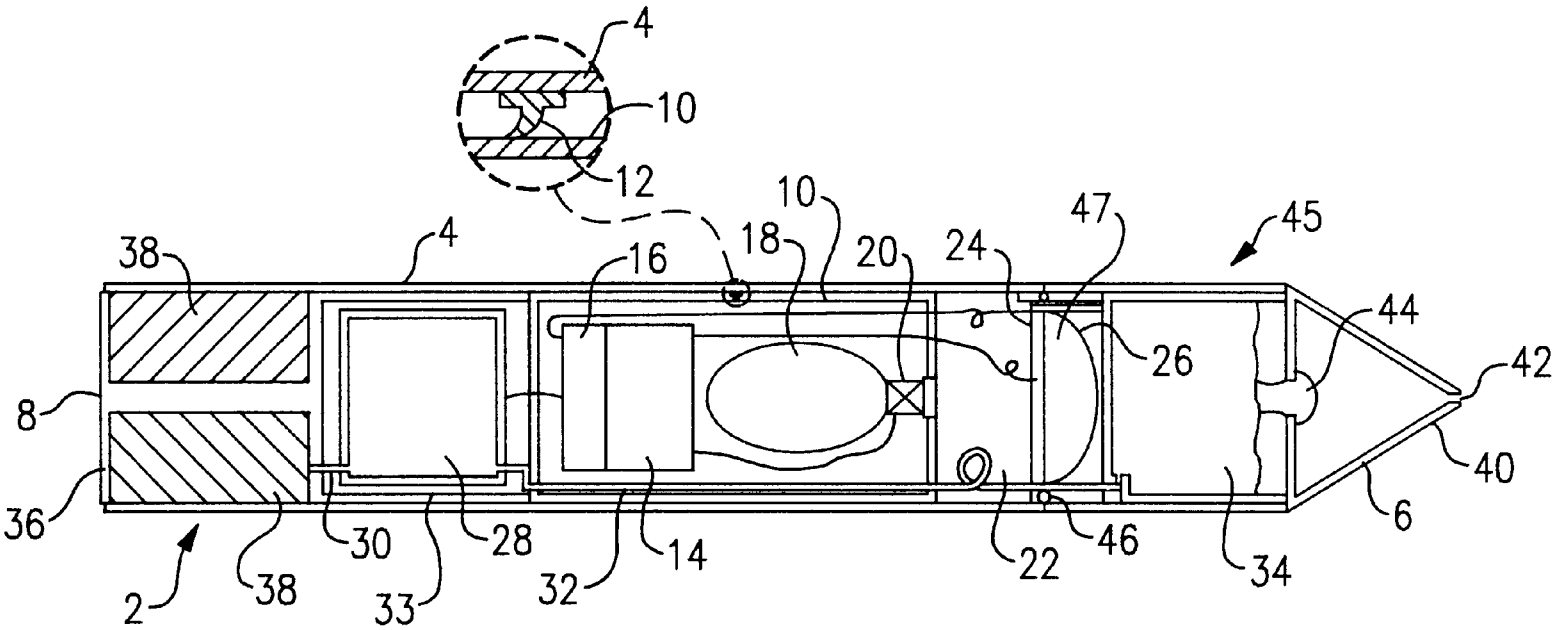
FIG. 1 is a diagrammatic representation of the buoy according to the present invention.
Figure 2:
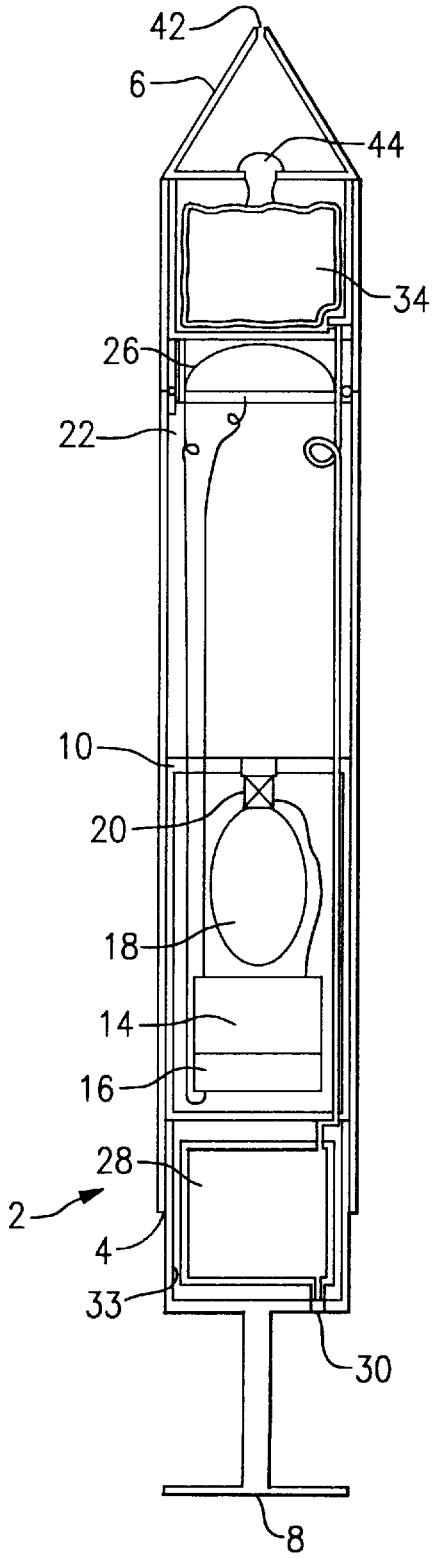
FIG. 2 is a diagrammatic view of the buoy of FIG. 1, in an extended state.
Figure 3:
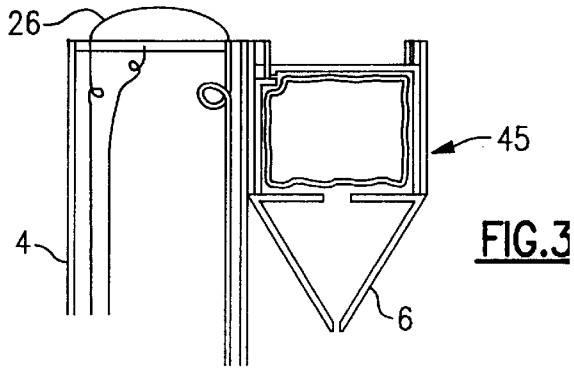
FIG. 3 is a fragmentary diagrammatic view of the buoy extended as in FIG. 2, with a nose cone ejected.
Figure 4:
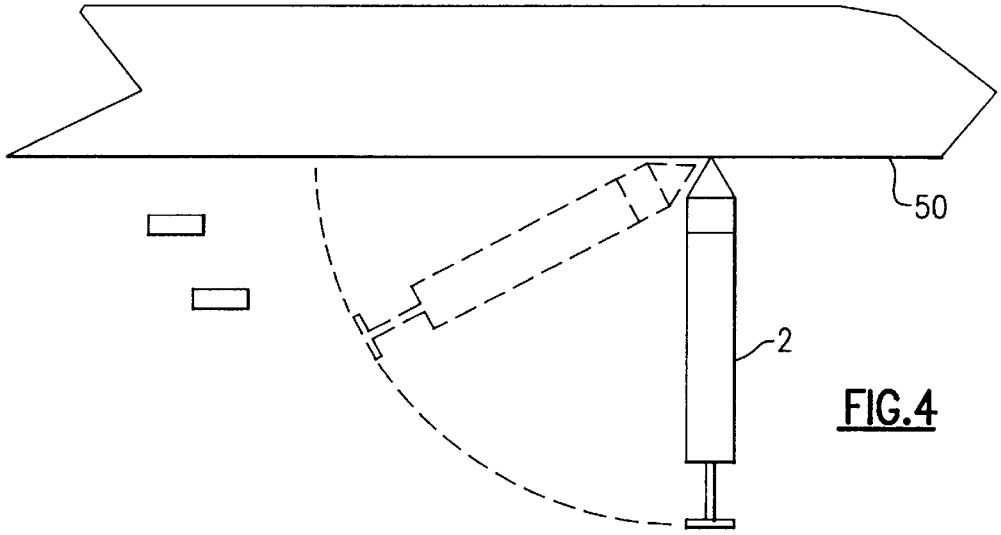
FIG. 4 is a diagrammatic representation of the buoy upon contact with an ice layer.

Referring first to FIG. 1, a data transmission buoy 2 capable of being deployed from an underwater (possibly unmanned) vehicle and of penetrating a surface layer of ice from one to two meters thick, comprises an elongate tubular housing 4, of a plastics material capable of maintaining adequate strength and resilience under sub-freezing temperatures (for example, polyethylene, polypropylene), closed at one end by a nose cone 6 of metal (for example, steel) and at its other, opposite, end by a weighted end closure 8 which is supported by a watertight pressure resistant equipment canister 10 sealed to the housing 4 by means of an lip seal 12 (see diagrammatic detail in FIG. 1). The canister is movable longitudinally of the housing from a retracted position, as shown in FIG. 1, to an extended position, as shown in FIG. 2, in which the weighted end closure 8 extends from the rear of the housing 4. In its retracted state, the buoy is approximately three and one half feet long and three and one half inches in diameter while in its extended state its length is increased by approximately one and one half feet.

The canister 10 houses an electronic control unit and transmitter 14 for acquiring, storing and transmitting data collected by the buoy itself or by the underwater vehicle (and subsequently transferred to the buoy) and for controlling the operation of the buoy itself. In addition, the control unit 14 preferably includes a GPS receiver for ascertaining the geographical location of the buoy for transmission with the aforementioned data during a transmission phase of the buoy's operation. The control unit and transmitter are powered by a battery 16 which also serves to power other electrically controlled systems of the buoy. This battery is provided with sufficient capacity for the desired operating life of a buoy and the transmission of the data referred to.

The canister includes a storage cylinder 18 for pressurized gas (for example, nitrogen) for supply, under the control of a pyrotechnic valve 20, controlled by the control unit 14, to a chamber 22 disposed between the inner end of the canister 10 and a closed diaphragm 24 which, facing the inner end of the nose cone 6, carries a data transmitting and G.P.S. antennae 26. The antennae 26 are connected by suitable electrical cable to receive a transmittable signal from the control unit and transmitter 14. To the rear of the canister 10 adjacent the weighted end closure 8 is an electrically driven pump 28 powered by the battery 16, under the control of the control unit 14, to pump seawater from an inlet 30 through a conduit 32 to a reactant carrying bladder 34 disposed adjacent the nose cone 6, when the buoy is in its extended state. The pump is housed in closed housing 33 filled with oil to resist water pressure exerted on housing 33.

Disposed between the housing 33 and a flange 36, which substantially closes the rear end of the housing 4, are flotation elements 38 of, for example, syntactic foam. These flotation elements 38 are held captive within the buoy when the buoy is in its retracted state but are free to float free when the buoy is in its extended state.

The closed diaphragm 24 is closed in a watertight manner to the forward end of the housing 4 and with the lip seal 12 ensures that the chamber 22 is not flooded with water.

The nose cone 6 has a conical forward end 40 having a centrally located, forwardly facing aperture 42. The bladder 34 is normally closed by a plug 44. The bladder 34 contains a reactant (for example, PZ). The plug 44 is constructed of a material which is impervious to the reactant and designed to open when a reaction of the PZ is initiated, by application of pressure generated by that reaction.

The nose cone 6 and bladder 34 containing portion of the housing 4 form an ice melter section 45 of the buoy 2.

A melter section ejection mechanism 46, under the control of the control unit 14, is provided in order to eject the nose cone by inflation of antenna balloon 47 from the buoy 2 when the transmission of data by the antennae 26 is desired. This ejection mechanism is a mechanical, spring loaded latch, activated by an antenna deployment system, controlled by the control unit, to inflate the balloon 47.

Figure 5:
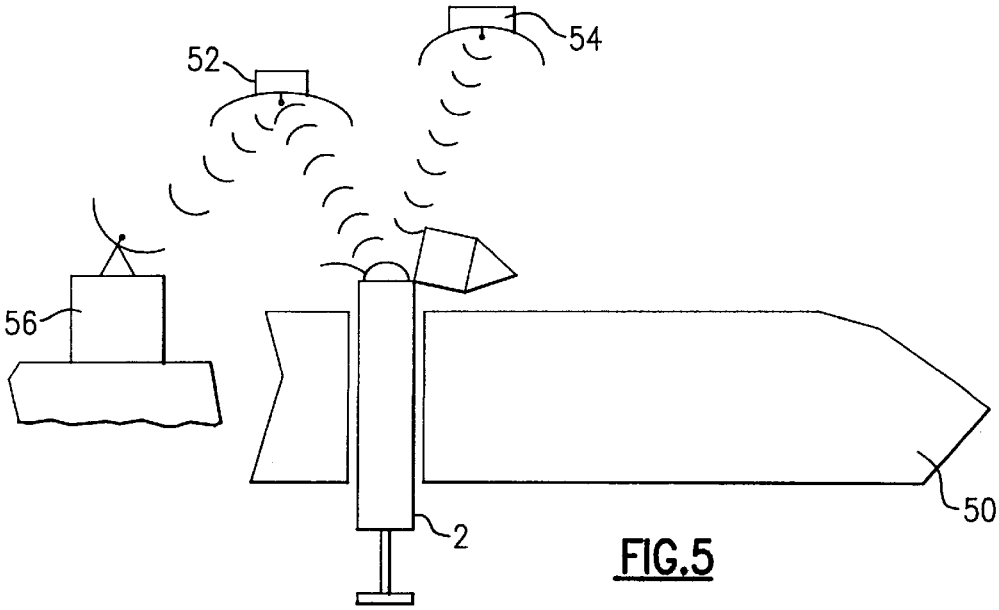
FIG. 5 shows the buoy during data transmission.

At the time of deployment by an underwater vehicle, the buoy 2 has a small net positive buoyancy of about one to about four ounces and is designed to assume a substantially horizontal orientation when free to do so. When deployed, the buoy 2 is released from an underwater vehicle to which it has been attached while acquiring desired data. A number of the buoys 2 may be carried by the underwater vehicle and deployed individually at desired times and/or locations. Upon deployment, the buoy 2 will float gently up to the surface of the water in which it has been deployed, (e.g. the Arctic Ocean), as a result of its low buoyancy of about one to about four ounces. When the freely floating buoy 2 encounters the underside of an ice layer 50, the control unit 14 is timed to initiate a sequence of operations as follows. Initially, the control unit 14 operates the pyrotechnic valve 20 to release the pressurized gas from the cylinder 18 into the chamber 22. The introduction of this gas under pressure into the chamber 22 moves the canister 10 and weighted end 8 longitudinally of the housing 2 into the position illustrated in FIG. 2. Once this extension of the buoy has been completed, the flotation elements 38 float freely away from the buoy with the result that the increased flotation volume of the chamber 22 and the loss of the flotation elements 38 (which essentially counterbalanced the weighted end closure 8 prior to longitudinal expansion of the buoy), causes the buoy to assume a vertical orientation as shown in FIG. 5 with its nose cone pressing against the underside of the ice layer 50. The change provided by the increased size of the chamber 22 and by the loss of the flotation elements 38 is arranged to provide an increased buoyancy to approximately one to two pounds, exerted against the underside of the ice layer 50.

Once the vertical orientation of the buoy 2 has been achieved, the control unit 14 starts the pump 28 which initially pumps a small quantity of hydrochloric acid (15% solution in water), which has been stored in the conduit 32, isolated between two check valves, to the reactant carrying bladder 34 in order to initiate an exothermic reaction with the PZ in the bladder 34. The reaction of the PZ and hydrochloric acid creates steam, the pressure of which unseats the plug 44 to release the steam into the conical end 40 of the nose cone 6 where that steam heats the conical end 40 and releases the steam through the aperture 42 onto the underside of the ice. Once the initial quantity of hydrochloric acid has been pumped to react with the PZ, the pump pumps seawater from the inlet 30 through the conduit 32 to maintain and fuel the reaction of the PZ.

The heated nose cone and steam emitted through the aperture 42 melts through the layer of ice which may be from one to two meters thick until the buoy 2, still in its vertical orientation, breaks through the layer of ice to expose the upper end of the buoy to the atmosphere. When this has occurred, the control unit 14 operates the melter section ejection mechanism 46 to inflate the antenna balloon to eject the melter section from the buoy to expose the antennae 26. The control unit and transmitter 14 then supply data carrying signals to the antennae 26 for transmission to a central receiver, for example, a satellite 52, for onward transmission, for example, to a central data receiving station 56. At this time, one of the antennae 26 can receive GPS signals from GPS satellites 54 for analysis by the control unit 14 to ascertain the geographical location of the buoy, which position can be then transmitted with the data transmission, as desired.

Although the steam producing reaction of PZ with hydrochloric acid and the fueling of that process by the subsequent supply of seawater is already known, reference is made to U.S. Pat. No. 4,923,019 for further details of an arrangement in which such a reaction is utilized to penetrate an ice cover. It will be appreciated that the arrangements for changing the buoyancy from a relatively low buoyancy of about one to about four ounces to a buoyancy approximately four times greater, make it possible for the buoy to gently float toward the surface of the water, thereby gently to contact the underside of an ice layer, in order to avoid damage which might otherwise occur when such contact is made by a rapidly rising buoy while providing the increase in buoyancy as the buoy is oriented into a vertical orientation whereby the steam heating the nose cone and ejected from the nose cone aperture can melt the ice layer while the buoy is maintained in firm contact with that ice layer to allow the buoy to burrow through the ice layer.

It will be appreciated that the control unit incorporates programming and sensors, etc. for ascertaining and controlling the functioning of the buoy as described above. As this programming and incorporation of sensors etc. does not form part of the present inventive advance and are of a nature apparent to those skilled in the relevant disciplines, they are not described herein.

| Reference numerals | |
|---|---|
| 2 buoy | 33 closed housing |
| 4 housing | 34 bladder |
| 6 nose cone | 36 flange |
| 8 weighted end closure | 38 flotation element |
| 10 canister | 40 conical end |
| 12 lip seal | 42 aperture |
| 14 control unit and transmitter | 44 plug |

-continued

| Reference numerals | |
|---|---|
| 16 battery | 45 ice melter section |
| 18 cylinder | 46 melter section ejection mechanism |
| 20 valve | 47 antenna balloon |
| 22 chamber | 50 ice layer |
| 24 closed forward end | 52 data satellite |
| 26 antennae | 54 GPS satellite |
| 28 pump | 56 central station |
| 30 inlet | |
| 32 conduit | |

What is claimed is:

1. A data transmitting buoy for use in transmitting data from ice covered bodies of water comprising:

a water tight elongate housing having a forward end and a rear end;

a transmitter within the housing;

an exposable antenna connected to the transmitter to transmit data;

a buoyancy and orientation adjusting system for adjusting the buoyancy and orientation of the buoy, when submerged in the water, upon contact with the ice, from a relatively low buoyancy to a relatively high buoyancy, in which high buoyancy condition the elongate housing is urged to a vertical orientation with the forward end uppermost; and an ice melting system to enable the buoy to burrow upwardly through the ice cover when in contact therewith in said vertical orientation.

2. The buoy of claim 1, wherein the buoyancy and orientation system axially extends the buoy from an unextended relatively low buoyancy state, in which the center of gravity of the buoy substantially coincides with the center of buoyancy of the buoy whereby the buoy has a substantially horizontal orientation, when submerged in the water and free to adopt such an orientation, to an extended relatively high buoyancy state in which the center of buoyancy of the buoy is closer to the forward end than is the center of gravity of the buoy thereby to urge the elongate housing to a vertical orientation.

3. A data transmitting buoy for use in transmitting data from ice covered bodies of water comprising:

a water tight elongate housing having a forward end and a rear end;

a transmitter within the housing;

an exposable antenna connected to the transmitter to transmit data;

a buoyancy and orientation adjusting system for adjusting the buoyancy and orientation of the buoy, when submerged in the water from a relatively low buoyancy to a relatively high buoyancy, in which high buoyancy condition the elongate housing is urged to a vertical orientation with the forward end uppermost; and an ice melting system to enable the buoy to burrow upwardly through the ice cover when in contact therewith in said vertical orientation, wherein the buoyancy and orientation system comprises:

an axially expandable chamber forward of the center of gravity of the buoy;

a container of pressurized gas releasable, when desired, to axially expand the chamber; and an equipment canister, within the housing, partially defining the chamber, having a weighted end at the rear end of the housing and being moveable axially relative to the housing to extend the buoy by expansion of the chamber;

whereby expansion of the chamber increases the buoyancy to the relatively high buoyancy, moves the equipment canister rearwardly of the buoy, provides the increased buoyancy forward of the center of gravity and together with the axial rearward movement of the equipment canister provides a center of buoyancy forward of the center of gravity of the buoy to urge the buoy to said vertical orientation.

4. The buoy of claim 3 comprising floats captively housed at the rear end prior to expansion of the chamber and freely releasable from the buoy upon the expansion of the chamber.

5. The buoy of claim 3 comprising a control unit within the canister to control the transmitter and a valve operable to release the gas from the container upon contact of the buoy with the underside of a surface layer of ice on the water.

6. The buoy of claim 5, wherein the ice melting system comprises a heat generator for melting the ice in contact with the buoy to allow the buoy to burrow upwardly through the layer of ice to expose the forward end and to allow exposure of the antenna for the transmission of said data, the heat generator being activated by the control unit.

7. The buoy of claim 6, wherein the heat generator comprises:

a reactant;

a pump housed in the canister and controlled by the control unit to pump, upon initial activation, a reaction initiator into the reactant to initiate an exothermic reaction and subsequently to pump water to fuel the reaction, to supply hot fluid to the forward end to melt the ice.

8. The buoy of claim 7, wherein the forward end is a conical metal nose cone, heated by the hot fluid, having a cental opening through which the hot fluid is emitted to melt the ice.

9. The buoy of claim 6, wherein the ice melting system is a heat generating composition, carried in an impervious bag closed by a plug which produces a hot pressurized fluid to unseat the plug to release the hot fluid to the nose cone to heat the nose cone and pass by way of a central opening in the nose cone to contact and melt the ice.

10. The buoy of claim 6, comprising a melter section ejector controlled by the control unit to eject the nose cone and the ice melting system from the buoy once the forward end of the buoy is exposed above the layer of ice thereby to expose the antenna for data transmission.

11. The buoy of claim 1 adapted for deployment by an underwater vehicle for the transmission of data collected underwater to a central station.

12. The buoy of claim 1, wherein the relative low buoyancy is about one to about four ounces thereby to promote only a gentle rate of upward movement of the buoy, when submerged in water, toward a said ice cover and the relatively high buoyancy is at least one pound to provide firm contact of the forward end of the buoy with the ice cover during the burrowing of the buoy through the ice cover.

13. An elongate data transmission buoy comprising:

an axially expandable housing;

an ejectable melter section at one end of the housing;

a weighted end section at an opposed end of the housing, an axially expandable chamber within the housing;

a source of pressurized gas;

a control system to release the pressurized gas from the source, when desired, into the chamber to axially expand the chamber and housing thereby to increase buoyancy of the buoy and through the operation of the weighted end section to orient the buoy vertically with the nose cone uppermost;

a heat producing system controlled by the control system to melt an ice layer, when contacted by the nose cone when the buoy is oriented vertically, to allow the buoy to burrow upwardly through the ice layer; and a melter section ejector operable by the control system following said burrowing through the ice layer to eject the melter section to expose an antenna, located in said housing, for transmission of the data under the control of the control system.

14. A data transmitting buoy for use in transmitting data from ice covered bodies of water comprising:

a water tight elongate housing having a forward end and a rear end;

a transmitter within the housing;

an exposable antenna connected to the transmitter to transmit data;

a buoyancy and orientation adjusting system for adjusting the buoyancy and orientation of the buoy, when submerged in the water, only upon contact with the ice, from a relatively low buoyancy to a relatively high buoyancy, in which high buoyancy condition the elongate housing is urged to a vertical orientation with the forward end uppermost; and an ice melting system to enable the buoy to burrow upwardly through the ice cover when in contact therewith in said vertical orientation.

* * * * *